US005432401A

United States Patent [19]

Satoh et al.

[11] Patent Number: 5,432,401

[45] Date of Patent: Jul. 11, 1995

[54] CORRECTING COIL OF DEFLECTION YOKE

[75] Inventors: Tatsuya Satoh; Masahiro Murakami, both of Nagaokakyo, Japan

[73] Assignee: Murata Mfg. Co., Ltd., Kyoto, Japan

[21] Appl. No.: 130,219

[22] Filed: Oct. 1, 1993

[30] Foreign Application Priority Data

Oct. 5, 1992 [JP] Japan ..... 4-290844
Oct. 6, 1992 [JP] Japan ..... 4-292266

[51] Int. Cl.[6] ..... H01F 7/00
[52] U.S. Cl. ..... 313/440
[58] Field of Search ..... 313/440; 335/210–214

[56] References Cited

U.S. PATENT DOCUMENTS

| | | | |
|---|---|---|---|
| 3,553,523 | 6/1971 | Budd | 315/368.27 |
| 3,848,207 | 11/1974 | Bussey et al. | 335/210 |
| 4,470,029 | 9/1984 | Chase | 335/210 |
| 5,014,029 | 5/1991 | Kawaguchi | 335/210 |
| 5,166,576 | 11/1992 | Roussel et al. | 313/440 |

*Primary Examiner*—Stephen Brinich
*Attorney, Agent, or Firm*—Townsend and Townsend Khourie and Crew

[57] ABSTRACT

There is provided a correcting coil of a deflection yoke wherein a correcting coil is brought into close and wide contact with a neck portion of a bobbin 1 of the deflection yoke by slightly altering the correcting coil which is used at present to further improve magnetic permeability and hence the amount of correction of magnetic lines of force. Correcting coil 11A of the deflection yoke includes a hollow correcting coil bobbin 13 on the outer periphery of which a coil 12 is wound and a core 14 configured into a U-shape by superimposing respective ends of two L-shaped core members made by laminating thin magnetic pieces 15 inside the correcting coil bobbin. A magnetic correcting piece 16 is provided which has a wider area and which makes contact with a neck portion 3 of the bobbin 1 of the deflection yoke 10 on the tip end of each leg part of said U-shaped core 14.

8 Claims, 6 Drawing Sheets

PRIOR ART

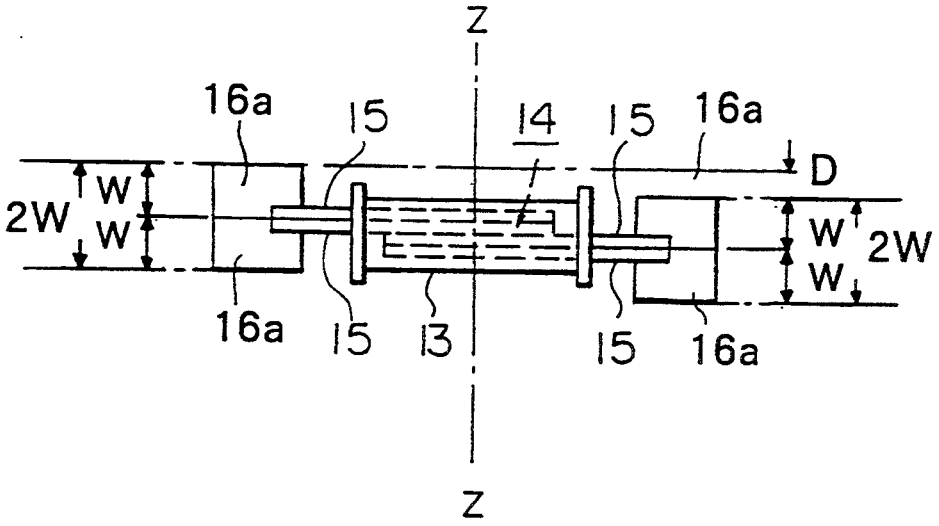
PRIOR ART
FIG.6
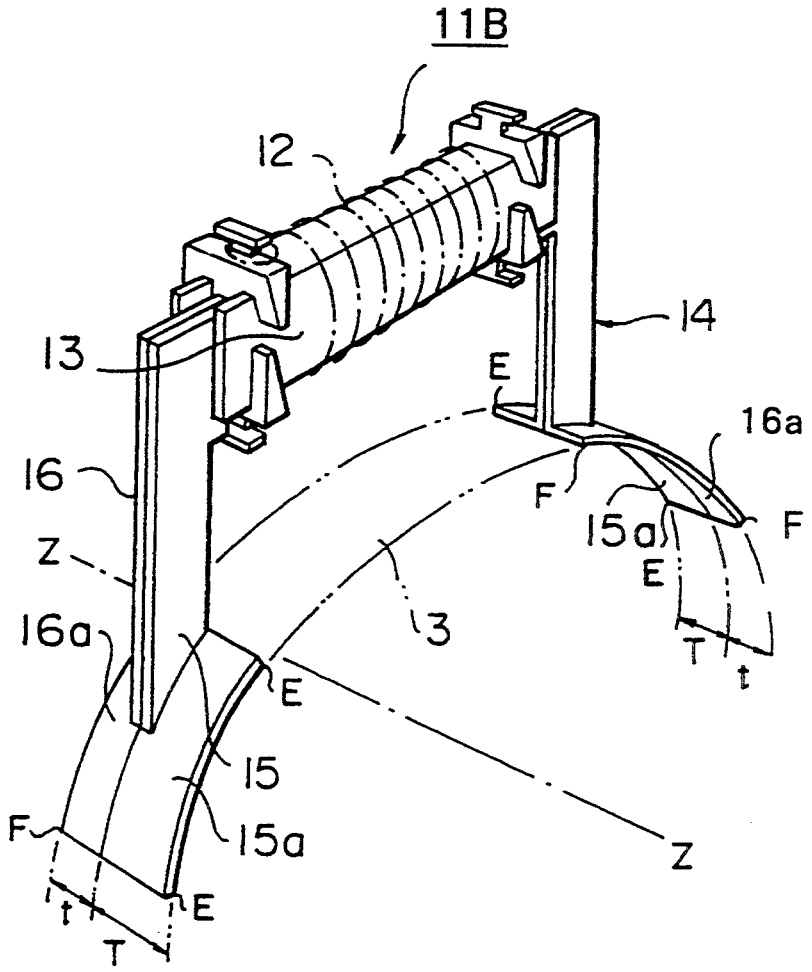

CORRECTING COIL OF DEFLECTION YOKE

BACKGROUND OF THE INVENTION

1. Field of the Invention

The present invention relates to a correcting coil of a deflection yoke for use in a cathode ray tube.

2. Description of the Prior Art

A cathode ray tube which is called a Braun tube of a television receiver includes a deflection yoke mounted on the external periphery of the cathode ray tube at the boundary between a neck and a funnel of the tube for deflecting vertically and horizontally an electron beam emitted from an electron gun contained in the neck located behind the Braun tube to correctly transfer a picture image everywhere on a screen.

Referring to FIG. 1, there is illustrated prior practice of such a deflection yoke for use in a cathode ray tube.

A typical deflection yoke 10 comprises a horn-shaped resin bobbin 1, a horizontal deflection coil (not shown) wound inside the bobbin 1 in a saddle shape, and a vertical deflection coil 2 wound outside the bobbin 1 in a saddle or toroid shape.

Such prior art television receivers, particularly color televisions, have a problem that any picture image is difficult to be seen because of its peripheral edges and the like being displaced. This is caused by a fact that three colors of the picture image are incorrectly superimposed. For solving the problem, a convergence characteristic of such a television receiver must be adjusted by deflecting the electron beams from electron guns such that three electron beams are converged at a single point on a screen even when those beams are deflected toward any location on the screen.

Some measures were taken as methods to adjust the convergence characteristic, such as those of adjusting winding distributions of horizontal and vertical deflection coils of a deflection yoke, and of sticking an image correction member such as a ferrite sheet to an inner surface of a tapered portion of the deflection yoke. For further improving the convergence characteristic, particularly the sensitivity of a green gun, there were mounted on the neck portion 3 of a deflection yoke two or four correcting coils 11 symmetrically arranged about an axial line Z—Z of the cathode ray tube.

Referring to FIG. 2, there is illustrated the prior art correcting coil 11 in the state where it is mounted on the neck portion 3 of the bobbin 1 of the deflection yoke 10.

The correcting coil 11 includes a hollow resin bobbin 13 around which a coil 12 is wound, and a U-shaped core 14 formed by the superimposed or overlapping ends of two L-shaped core members which overlap inside of bobbin 13 for guiding magnetic lines of force. The L-shaped core member comprises superimposed thin silicon steel magnetic pieces 15, 15 of about 0.5 mm thickness for example. The other ends of the L-shaped core members, i.e., tip ends **14*a* of two legs of the L-shaped core 14, make close contact with the neck portion 3 of the horn-shaped bobbin 1 of the deflection yoke 10 to smoothly guide the magnetic lines of force generated by the correcting coil 11** to the cathode ray.

For increasing the efficiency of the correcting coil 11, i.e., the amount of correction of the magnetic force lines, the following methods are considered:

(1) altering the number of windings of the correcting coil 11, (2) altering the number or the shape of the cores 14 for use in the correcting coil 11, and (3) improving close contact conditions between the tip ends **14*a* of the two legs of the core 14 of the correcting coil 11 and the neck portion 3 of the horn-shaped bobbin 1 of the deflection yoke 10**.

These methods however suffer from some difficulties: the method (1) has a problem on the structure and a problem of a sensitivity change (resistance change), the method has an additional problem of a molded member for holding the correcting coil being in need of alteration, and the method (3) has a problem of clearance which might be caused by machining accuracy and a temperature change of the deflection yoke.

SUMMARY OF THE INVENTION

In view of the drawbacks with the prior art, it is a first object of the present invention to provide a correcting coil of a deflection yoke capable of further improving magnetic permeability and hence the amount of correction by bringing the tip ends of the core into close contact with a neck portion of a bobbin of the deflection yoke.

It is another object of the present invention to provide a correcting coil correctly mounted on the deflection yoke such that locations of opposite ends of the core are not displaced in the direction of a Z axis and having a structure capable of improving the amount of correction by effectually applying magnetic lines of force to a cathode ray tube.

To achieve the aforementioned first object, a correcting coil of a deflection yoke according to the present invention comprises a hollow correcting coil bobbin on the outer periphery of which a coil is wound, and an L-shaped core constructed by the ends of two L-shaped core members inside the correcting coil bobbin. The two L-shaped core members are made by lamination thin magnetic pieces, and by providing magnetic correcting pieces each having wider areas and each making contact with the neck portion of the bobbin of the deflection yoke on the tip end of the leg portion of said U-shaped core.

In accordance with the first aspect of the present invention, the magnetic correcting pieces are connected with the tip ends of the opposite legs of the U-shaped core, and there is an increased area of close contact between the magnetic correcting piece and the cylindrical neck portion of the bobbin of the deflection yoke. The magnetic lines of force generated by the correcting coil are thereby effectually guided to the cathode ray tube for their application to the same, and hence the amount of correction of coma aberration of the correcting coil is improved.

To achieve the aforementioned second object, a correcting coil of a deflection yoke of a cathode ray tube according to the present invention comprises a hollow correcting coil bobbin on the outer periphery of which a coil is wound, and a U-shaped core constructed by superimposing inside said correcting coil bobbin the ends of two L-shaped core members, each said L-shaped core member comprising two superimposed U-shaped thin magnetic pieces, each of which has a correcting piece brought into the cylindrical neck portion of the deflection yoke bobbin, and is characterized in that the correcting pieces of the two magnetic pieces have different sizes in the direction of a tube axis (Z axis) of the cathode ray tube. The correcting pieces of the core members are brought into contact with the cylindrical neck portion of the deflection yoke bobbin having the same overall areas. The opposite side edges of the correcting pieces extend in the direction of the Z axis and are located on the same flat plane extending perpendicularly to the Z axis.

In accordance with the second aspect of the present invention, the two magnetic pieces each including the correcting pieces of different sizes in the direction of the Z axis are superimposed. The entire area of each correcting piece brought into contact with the cylindrical neck portion of the deflection yoke bobbin is made equal to the other, and opposite side edges of the entire correcting piece lie in a plane perpendicular to the Z axis. The opposite ends of the core of the correcting coil are thereby brought into close contact with the cylindrical neck portion at a proper location and in mutual alignment. Magnetic lines of force generated by the correcting coil are therefore effectually applied on the cathode ray tube to improve the amount of coma aberration.

BRIEF DESCRIPTION OF THE DRAWINGS

FIG. 5 is a plan view illustrating the prior art correcting coil;

FIG. 6 is a perspective view illustrating another embodiment of the correcting coil according to the present invention;

DETAILED DESCRIPTION OF THE PREFERRED EMBODIMENT

In what follows, an embodiment of the present invention will be described with reference to the accompanying drawings.

Figure 1:
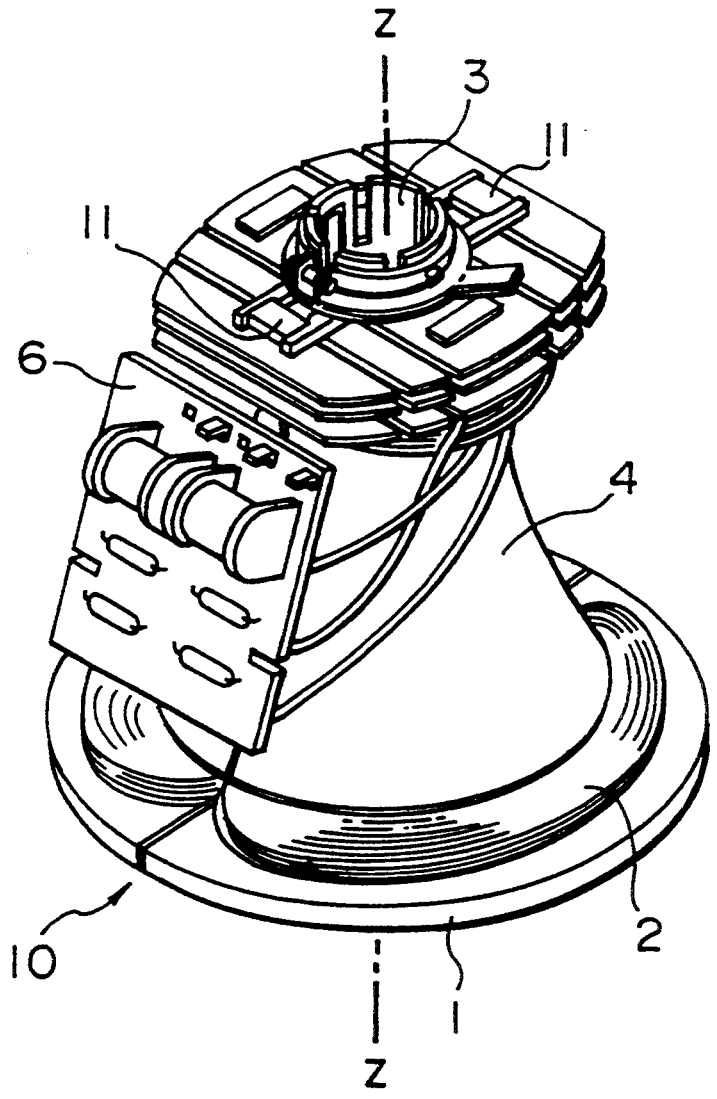
FIG. 1 is a perspective view illustrating a deflection coil for a cathode ray tube on which coil a correcting coil according to the present invention is mounted.
Figure 2:
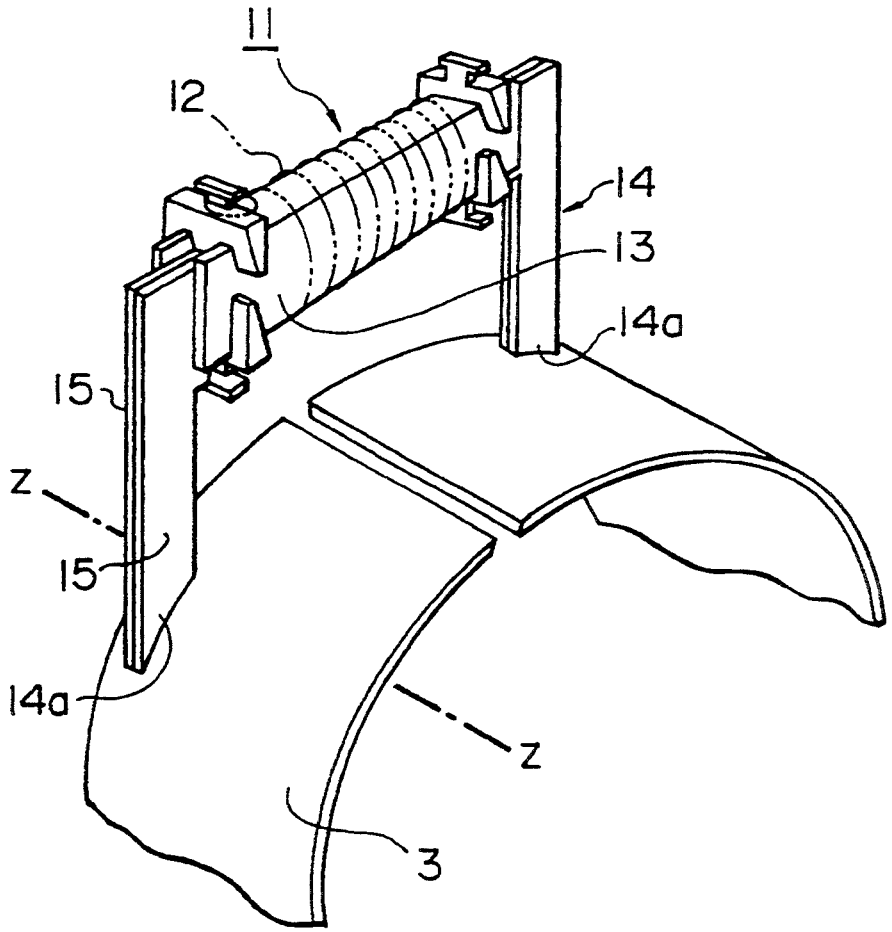
FIG. 2 is a perspective view illustrating the state of a prior art correcting coil mounted on a deflection yoke.

A deflection yoke 10 on which a correcting coil of the present invention is mounted is identical in other construction to that of the prior art example illustrated in FIG. 1 and hence the drawing therefor will be omitted.

Figure 3:
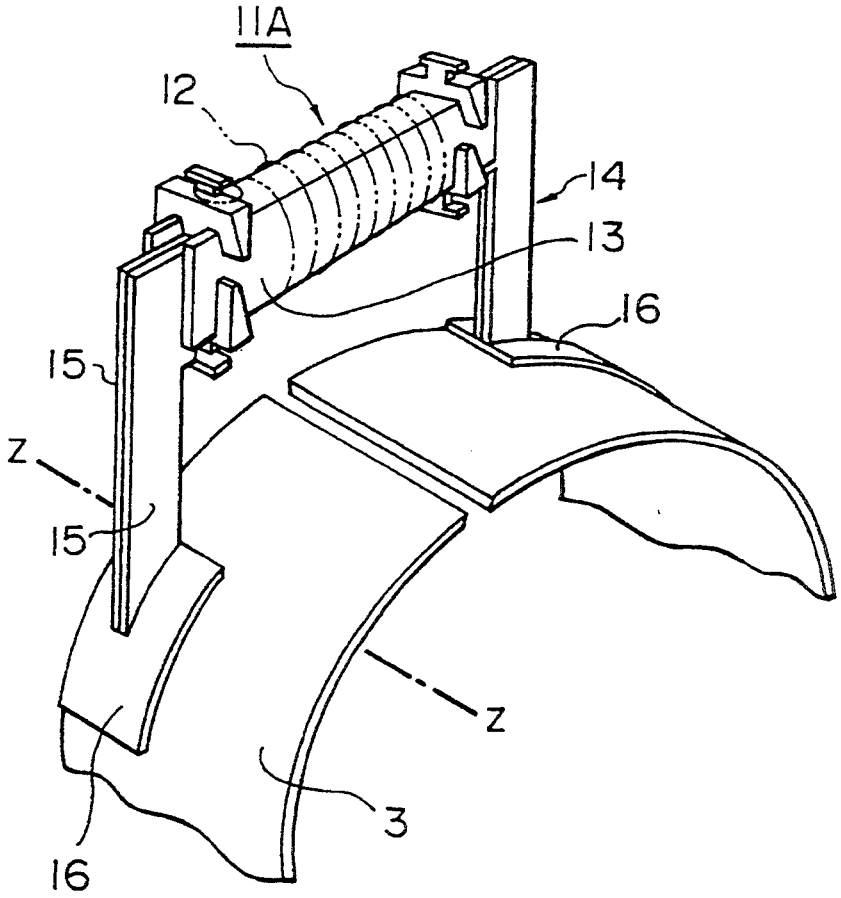
FIG. 3 is a perspective view illustrating the state of an embodiment of the correcting coil according to the present invention mounted on a deflection yoke.

Referring to FIG. 3, there is illustrated an embodiment of the correcting coil according to the present invention.

A core 14 is constructed by superimposing and connecting in a U-shape respective ends of left and right L-shaped core members in a hollow part of a bobbin 13. Each core member is made by superimposing two thin plate magnetic pieces 15, 15 of the thickness of 0.5 mm for example as illustrated in FIG. 3.

A correcting piece 16 which comprises a magnetic substance such as a steel silicon plate is mounted on the tip end of each of both leg portions of the U-shaped core 14 constructed by lamination of the thin plate magnetic pieces 15. The correcting piece 16 has a wider curved surface which makes close contact with the neck portion 3 of the bobbin 1 of the deflection yoke 10. The correcting piece 16 may be formed integrally with the magnetic pieces 15 by folding the magnetic pieces 15, or may be fabricated independently of the magnetic piece 15 and be bonded to the tip ends of legs of the core 14 through a bonding agent or be mechanically fixed onto the neck portion 3. A magnetic flux from the correcting coil 11A is effectually guided to a cathode ray tube located inside the neck portion 3 through the correcting piece 16.

According to the present invention, as described above, the magnetic correcting pieces, each of which makes contact with the neck portion of the bobbin of the deflection yoke and has a wider area, are provided on the tip ends of the leg portions of the aforementioned U-shaped core. Accordingly, the correcting coil is brought into close and wide contact with the neck portion of the deflection yoke and hence magnetic lines of force generated by the correcting coil and a horizontal deflection coil connected with the correcting coil are effectually applied to the cathode ray tube through the bobbin of the deflection yoke to improve the efficiency of the coma aberration.

Figure 4:
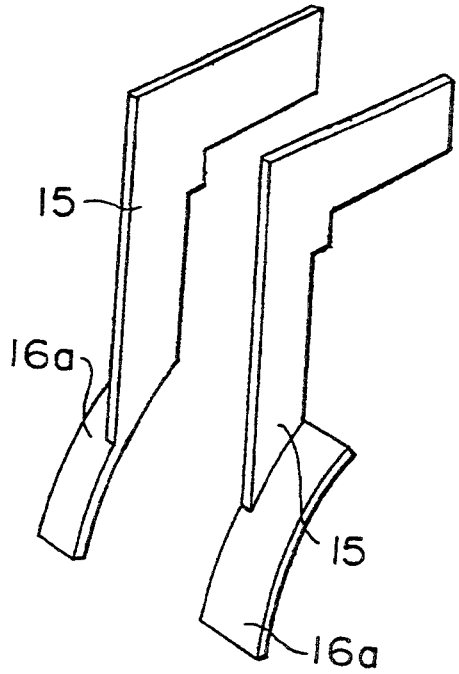
FIG. 4 is a perspective view illustrating a pair of L-shaped core members of the correcting coil according to the present invention.

It is noted that for the correcting piece 16 of the correcting coil 11A disclosed as the aforementioned first embodiment it is made upon construction of an actual correcting coil 11A by superimposing two correcting piece halves 16*a*. Each correcting piece half is folded at a right angle at the tip end of the leg of the corresponding magnetic piece 15 as is illustrated in FIG. 4. In that case, however, once there is fabricated the correcting coil 11A using such a magnetic piece 15 as illustrated in FIG. 4, correcting pieces 16, 16 at both legs are equal in their widths W in the direction of the Z axis to each other but are displaced a distance D (1.0 mm for example) in the direction of the Z axis. This causes distortion of a picture image on the cathode ray tube. Another embodiment of the present invention illustrated in FIG. 6 solves this difficulty. In FIG. 6 like parts have the same reference symbols and numbers as in FIG. 3.

Referring to FIG. 6, a U-shaped core 14 of the correcting coil 11B is constructed by superimposing and coupling pairs of left and right U-shaped core members. Further, the core member is made by superimposing a thin plate magnetic piece 15 and a thin plate magnetic piece 16 as illustrated in FIG. 7.

Figure 8A:
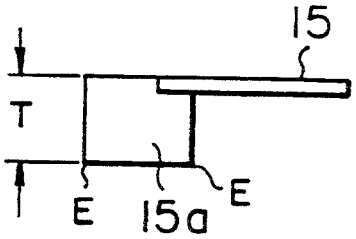
FIGS. 8A and 8B are a plan view and a front view, each illustrating one magnetic piece constituting an L-shaped core member which constructs a core of the correcting coil according to the present invention.
Figure 8B:
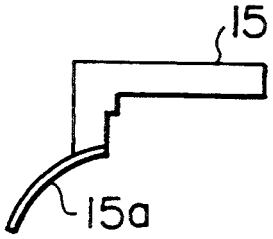
Figure 9A:
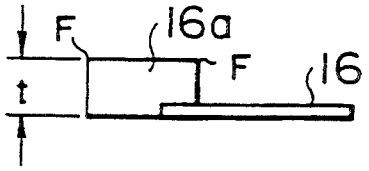
FIGS. 9A and 9B are a plan view and a front view, each illustrating the other magnetic piece constituting the L-shaped core member which constructs the core of the correcting coil according to the present invention.
Figure 9B:
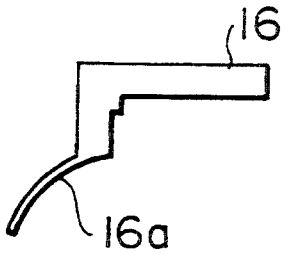

The thin plate magnetic piece 15 comprises a thin steel plate of the thickness of 0.5 mm for example such as a silicon steel plate as illustrated in FIGS. 8A and 8B, at one end of which a correcting piece half 15*a* in close contact with the neck portion of the deflection yoke is folded so as to protrude to one side. Correcting piece half 16*a* protrudes oppositely to the correcting piece half 15*a*. The correcting piece half 16*a* has a width "t" in the direction of the Z axis which is smaller than the width "T" of the correcting piece half 15*a*.

Superposition of the foregoing two thin plate magnetic pieces 15, 16 ensures the correcting piece half parts 15*a*, 16*a* to be connected in the direction of the Z axis for close contact with the neck portion 3 of the deflection yoke. Further, the parts of the thus assembled two L-shaped members to which no correcting piece is attached are inserted into a hollow part of the bobbin 13 from both sides thereof and are superimposed to define core 14 for completion of the correcting coil 11B.

Figure 7:
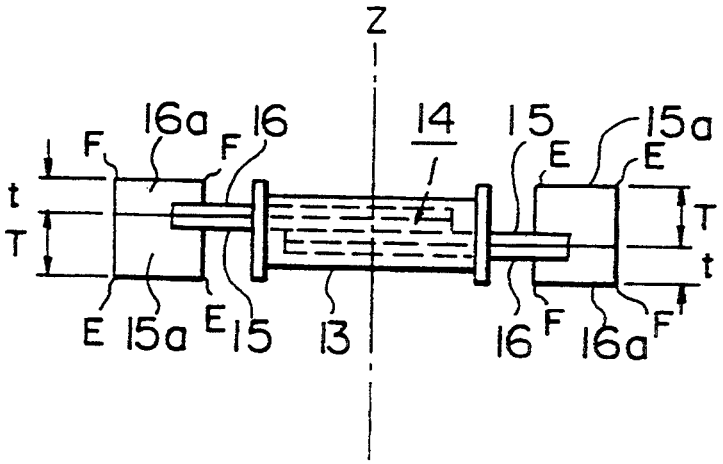
FIG. 7 is a plan view illustrating the correcting coil according to the present invention.

The widths of the entire correcting pieces of the two L-shaped core members constructed by superposition of the two magnetic pieces 15, 16 are "T+t", as illustrated in FIG. 7, and hence areas of the entire correcting pieces are equal to each other. Further, side edges E—E, F—F of the entire correcting pieces in the Z direction of the superimposed magnetic pieces are located on the same flat plane extending perpendicularly to the Z axis, respectively.

According to the present invention, as described above, the core member is constructed by superimposing the two magnetic pieces including the correcting pieces of the different widths in the direction of the axis of the cathode ray tube (Z axis), and the two ends of the two core members are superimposed on and connected with each other in the bobbin to construct the core of the correcting coil. The areas of the entire correcting pieces of the core member in contact with the cylindrical neck part are thereby made equal on the left and right sides, and both side edges of the entire correcting piece of the core member are located on the same flat plane oriented perpendicularly to the Z axis, respectively. Thus, the correcting coil is correctly brought into close contact with the neck part of the deflection yoke and hence magnetic lines of force generated by the horizontal deflection coil connected with the correcting coil are effectively applied to the cathode ray tube to improve the amount of coma aberration.

What is claimed is:

1. A correcting coil for placement into contact with a neck portion of a bobbin of a deflection coil for a cathode ray tube comprising a U-shaped core defining first and second legs and formed by partly superimposing first and second L-shaped core members, said legs including tip ends, and correcting pieces having equal areas for establishing contact between the tip ends of the legs of said core and the neck portion of the bobbin.

2. A correcting coil of a deflection yoke according to claim 1 wherein each of said correcting pieces comprises a folded tip end of said leg of the core.

3. A correcting coil of a deflection yoke according to claim 1 wherein each of said correcting pieces comprises a member independent of the core and attached to the tip end of said leg of the core.

4. A correcting coil of a deflection yoke according to claim 1 wherein said first and second L-shaped core members each comprise first and second laminated magnetic pieces each of which includes a tip end, the first and second laminated magnetic pieces including respective correcting pieces of different sizes extending in opposite directions away from the laminated magnetic pieces.

5. A correcting coil for placement into contact with a neck portion of a bobbin of a deflection coil for a cathode ray tube, the correcting coil comprising a U-shaped core forming a center portion and spaced-apart, first and second legs extending from ends of the center portion and terminating in free leg ends, and a correcting piece operatively coupled to each free leg end for establishing intimate, magnetic flux transmitting contact with the neck portion of the deflection coil, the correcting pieces having like areas of contact with the neck portion.

6. A correcting coil according to claim 5 wherein the U-shaped core is defined by first and second L-shaped core members each comprising first and second legs, first legs of the L-shaped members overlapping each other to define the center portion of the U-shaped core.

7. A correcting coil according to claim 6 wherein the correcting plates are integrally constructed with the corresponding second legs.

8. A correcting coil according to claim 6 wherein the L-shaped core members each comprise first and second L-shaped laminations, and wherein the correcting piece for each leg of the U-shaped member is defined by first and second plates extending substantially perpendicularly away from the respective first and second L-shaped laminations by differing amounts, so that lateral edges of the plates extending from the first and second L-shaped laminations of the first and second legs, respectively, are aligned with each other.

* * * * *